US009452868B2

(12) United States Patent
Garcia Cortes

(10) Patent No.: US 9,452,868 B2
(45) Date of Patent: Sep. 27, 2016

(54) DEVICE FOR POURING LIQUID CONTAINED IN A CONTAINER

(71) Applicant: Maria Juana Garcia Cortes, Cadiz (ES)

(72) Inventor: Maria Juana Garcia Cortes, Cadiz (ES)

( * ) Notice: Subject to any disclaimer, the term of this patent is extended or adjusted under 35 U.S.C. 154(b) by 0 days.

(21) Appl. No.: 14/429,170

(22) PCT Filed: Aug. 7, 2013

(86) PCT No.: PCT/ES2013/070583
§ 371 (c)(1),
(2) Date: Mar. 18, 2015

(87) PCT Pub. No.: WO2014/044885
PCT Pub. Date: Mar. 27, 2014

(65) Prior Publication Data

US 2015/0217909 A1 Aug. 6, 2015

(30) Foreign Application Priority Data

Sep. 18, 2012 (ES) ..... 201231445

(51) Int. Cl.
*B65D 47/06* (2006.01)
*B65D 47/12* (2006.01)
*B65D 47/04* (2006.01)
*B65D 83/48* (2006.01)

(52) U.S. Cl.
CPC ..... *B65D 47/061* (2013.01); *B65D 47/043* (2013.01); *B65D 47/122* (2013.01); *B65D 47/127* (2013.01); *B65D 83/48* (2013.01)

(58) Field of Classification Search
CPC B65D 47/127; B65D 47/122; B65D 47/061; B65D 47/043; B65D 47/063; B65D 47/244; B65D 47/245; B65D 47/248; B65D 83/48
See application file for complete search history.

(56) References Cited

U.S. PATENT DOCUMENTS 1,977,869 A * 10/1934 Ulm ..... B65D 47/2093 222/492
2,147,289 A * 2/1939 Furedy ..... B65D 47/061 222/484
2,828,893 A * 4/1958 Stewart ..... B65D 47/242 222/453
3,217,935 A * 11/1965 Burt ..... B65D 47/061 222/109
5,944,235 A * 8/1999 Won ..... B65D 47/248 222/506

(Continued)

FOREIGN PATENT DOCUMENTS

CH 498753 A2 11/1970
CN 202030137 U 11/2011

(Continued)

*Primary Examiner* — Frederick C Nicolas
*Assistant Examiner* — Bob Zadeh
(74) *Attorney, Agent, or Firm* — Albert Bordas, P.A.

(57) ABSTRACT

A device for pouring liquid contained in a container, including a base body which snap fits onto the outlet of the container, the base body forming a cavity in which a pouring element is contained, a spring which pushes the pouring element out of the base body, a cap which, owing to it being coupled to the base body, retracts the spring and the pouring element into the cavity of the base body, characterized in that the spring is isolated inside an encapsulated housing formed by an inner cylindrical wall, which juts out from the base body and is telescopically pressure-inserted in an outer cylindrical wall arranged in the center of the pouring element, and a peripheral duct is formed between the housing and the inner walls of the base body and the pouring element for pouring the liquid outwardly of the container.

14 Claims, 5 Drawing Sheets

(56) References Cited

U.S. PATENT DOCUMENTS

| | | | | |
|---|---|---|---|---|
| 5,957,313 | A * | 9/1999 | Bouan | B65D 45/32 215/215 |
| 6,299,037 | B1 * | 10/2001 | Lee | B65D 47/248 222/518 |
| 6,976,610 | B2 * | 12/2005 | Rigel | B65D 47/061 141/308 |
| 7,661,245 | B2 * | 2/2010 | Brown | B67B 3/2066 53/317 |
| 8,485,397 | B2 * | 7/2013 | Hammarin | 222/153.05 |
| 2015/0217909 | A1 * | 8/2015 | Garcia Cortes | B65D 47/061 222/511 |

FOREIGN PATENT DOCUMENTS

| | | | |
|---|---|---|---|
| DE | 3143319 | A1 | 5/1983 |
| WO | 2004113176 | A2 | 12/2004 |

* cited by examiner

DEVICE FOR POURING LIQUID CONTAINED IN A CONTAINER

DISCLOSURE

Object of the Invention

The present invention relates to a device for pouring liquid contained in a container, which is pressure-inserted in the outlet of said container, to allow the pouring of the liquid without spillage through the outer wall of the container.

BACKGROUND OF THE INVENTION

Multiple solutions are known which are included in containers or bottles that facilitate pouring or drinking the liquid contained in said container. The liquid contained in the container may be an alcoholic beverage, juice, soda, oil, etc.

For example, patent document WO 01/51406, published on 19 Jul. 2001, shows a spout assembly of a liquid held in a bottle that includes a cylindrical sleeve fixed in the neck of the bottle and a spout extending through said sleeve.

The spout is movable between an extended position, in which it protrudes outwardly from the neck of the bottle to facilitate the pouring of the contents of the bottle, and a retracted position, in which it is disposed inside the neck when the bottle is closed by a cap.

The spout assembly further includes a coil spring which normally keeps the spout in its extended position, but is compressible to permit moving said spout to its retracted position.

The spout is made up of a first passage for pouring the liquid and a second passage for returning the air into the bottle when its contents are poured.

On the other hand, patent document DE 3143319, published on 11 May 1983, relates to a pourer for bottles, which has a basic body, which can be inserted into the neck of a bottle in the manner of a stopper, which includes a pouring tube and a venting duct.

The pouring tube, which is arranged parallel to the venting duct, is movable outwardly of the bottle and can be retracted inwards, compressing a spring.

A sealing surface is disposed inside a cover, which is screwed to the neck of the bottle and holds the pouring tube inside the bottle.

Furthermore, a device for drinking or pouring liquid from a container consisting of a cap provided with two orifices, which snap fits onto the mouth of the container, is known from utility model document ES 1007512 U, published on 1 Feb. 1989.

In one of the orifices there is arranged an air inlet tube whose upper end is flush with the flat surface of the cap and which is of such a length that it extends down almost to the bottom of the container.

The other orifice is coupled to a liquid outlet tube of smaller length, which comprises a flaring at its lower end serving as a seat for the end of a spring, which ejects said tube outwardly when the lid of the container is removed.

The abovementioned solutions have disadvantages in that they are difficult to assemble and mount on the mouth of the container in an automatic manner, requiring being assembled by hand, which makes the product more expensive.

On the other hand, another drawback, which has been observed in said known solutions is that, when the liquid is poured outwardly, it comes into contact with the spring, thus forcing the spring to be made of stainless steel in order to meet health regulations, something, which similarly increases the production cost.

DESCRIPTION OF THE INVENTION

In view of the above, the present invention relates to a device for pouring liquid contained in a container.

The device comprises a base body, which snap fits onto the outlet of the container. The base body forms a cavity in which a pouring element is contained.

Between the base body and the pouring element there is arranged a spring which pushes the pouring element out of the base body. This occurs when the spring is not subjected to a compressive force.

A cap, which, owing to it being coupled to the base body, retracts the spring and the pouring member into the cavity of the base body. In this case, the spring is affected by a compressive force, which makes its extended position to change.

For its part, said cap is arranged inside a capsule, which screws onto the outer wall of the outlet of the container.

The device is characterised in that the spring is isolated inside an encapsulated housing formed by an inner cylindrical wall and an outer cylindrical wall.

The inner cylindrical wall is located on the base body, it being telescopically pressure-inserted in the outer cylindrical wall. For its part, the outer cylindrical wall is arranged in the centre of the pouring member.

Likewise, a peripheral duct is formed between the encapsulated housing and the inner walls of the base body and the pouring element.

Thus, the liquid travels freely through the formed peripheral duct, i.e. the pouring of the liquid outwardly of the container is achieved without its coming into contact with the spring, which is isolatedly arranged inside the encapsulated housing.

This is why it is possible to manufacture the spring in common, not stainless, steel, thereby lowering the cost of manufacturing the device.

The formed peripheral duct also eliminates the need for an additional ventilation tube or duct without a vacuum being created inside the container upon the pouring of the liquid, thus achieving a constant outflow of the liquid and safely controlling the amount to be poured.

On the other hand, thanks to the simplicity of its components, the device is very easy to automatically assemble and mount in high-production lines, which likewise reduces its production cost.

BRIEF DESCRIPTION OF THE DRAWINGS

The present specification is complemented with a set of figures, which are illustrative of the preferred embodiment of, and never limit, the invention.

DETAILED DESCRIPTION OF THE INVENTION

Figure 1:
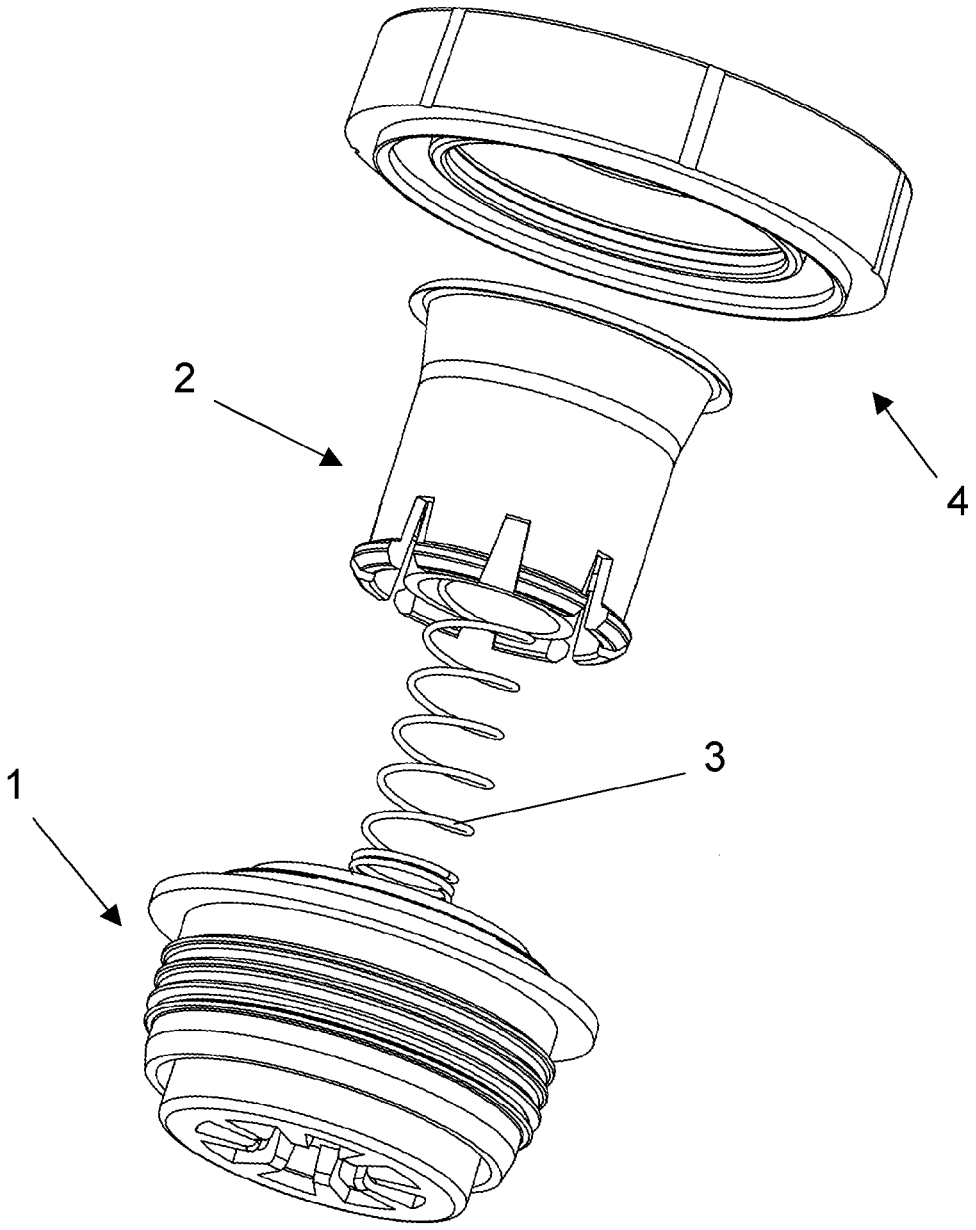
FIG. 1 shows an exploded perspective view of the device for pouring liquid.
Figure 2:
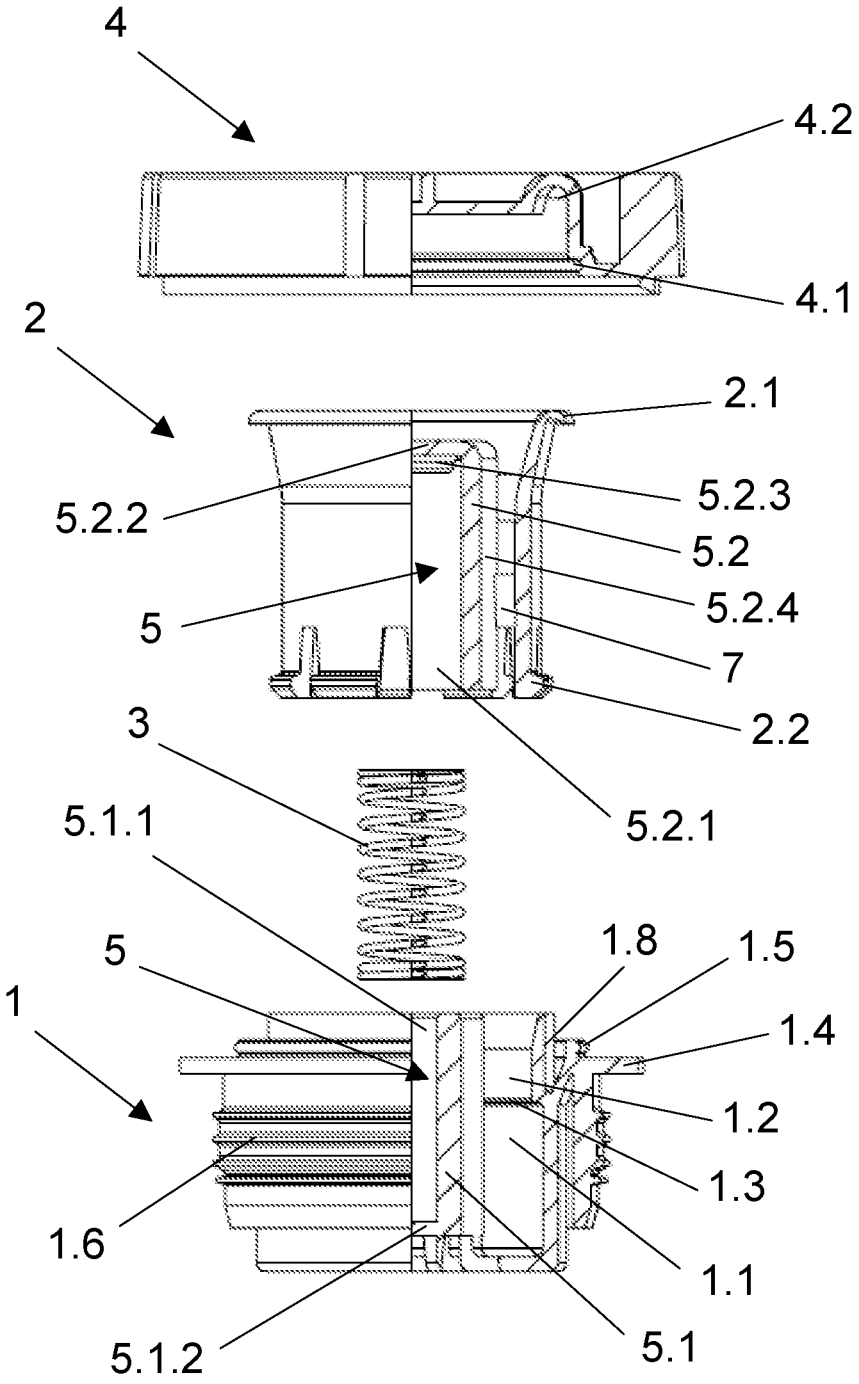
FIG. 2 shows a sectional front view of the device for pouring liquid.
Figure 3:
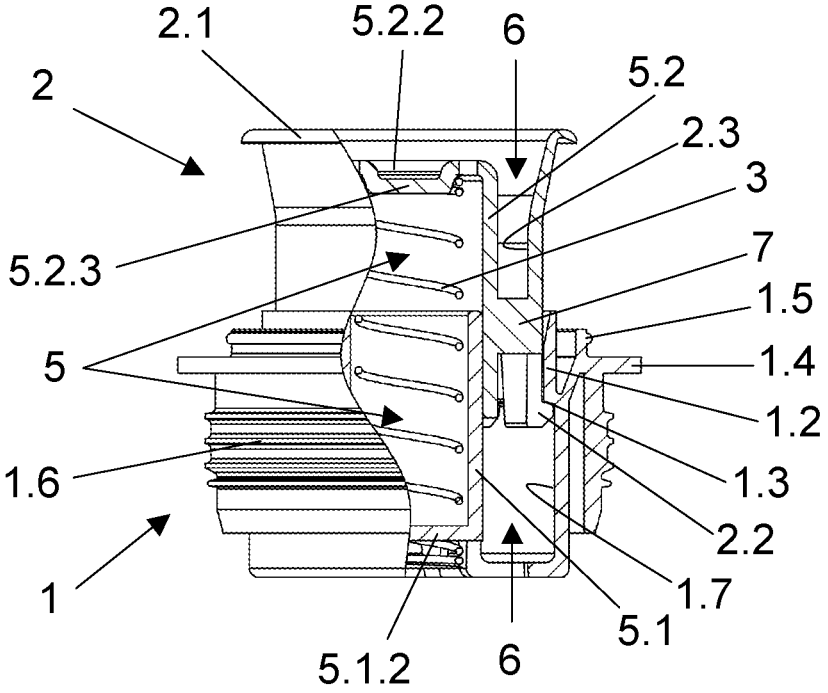
FIG. 3 shows a sectional front view of the device for pouring liquid with the pouring element outside the cavity of the base body.
Figure 4:
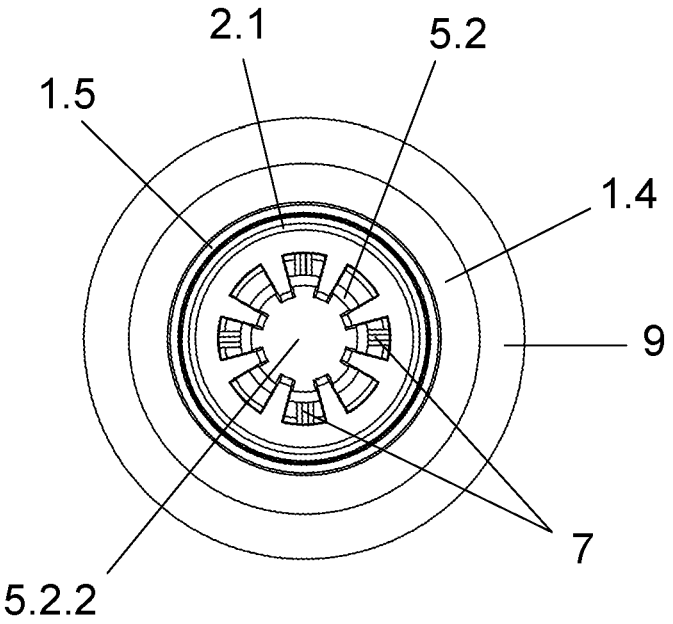
FIG. 4 shows a top view of the device for pouring liquid.
Figure 5:
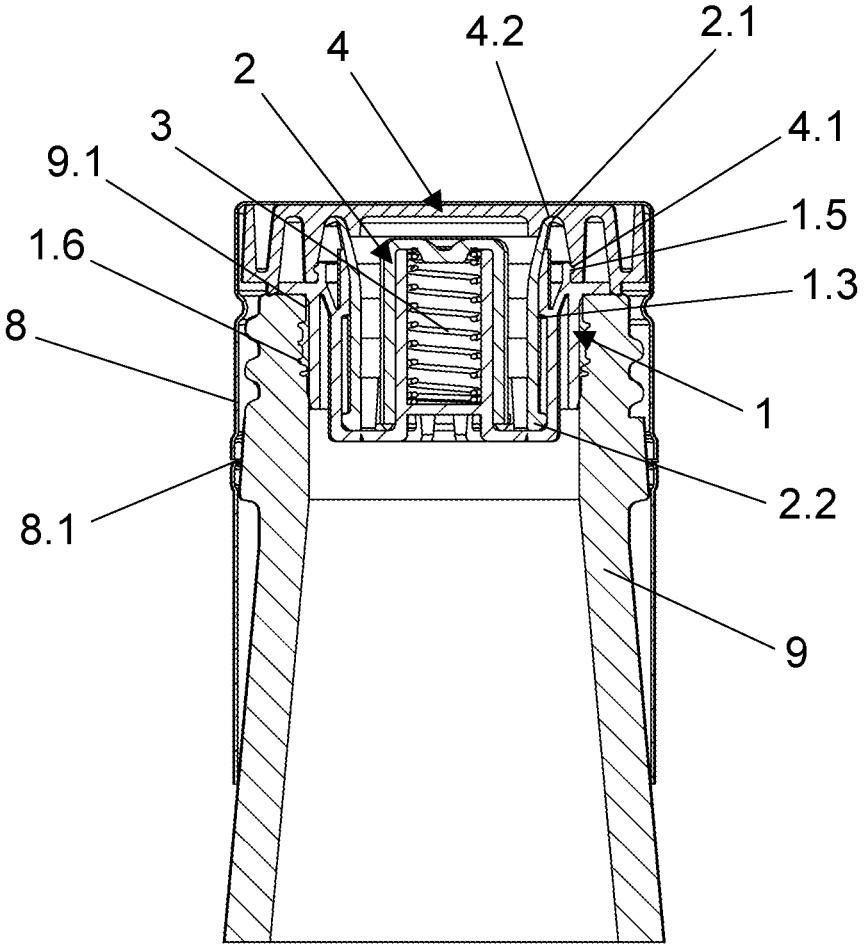
FIG. 5 shows a sectional front view of the device for pouring liquid with the pouring element retracted inside the cavity of the base body.

In view of the above, the present invention relates to a device for pouring liquid contained in a container.

As can be seen in the figures, the device comprises a base body (1), which snap fits onto the mouth of the container. Said base body (1) may comprise a plurality of annular ribs (1.6) on its outer wall for achieving greater fastening and tightness between the device and the container.

The base body (1) forms a cavity (1.1) in which a pouring element (2) is contained after it has been pressure-inserted.

To this end, the lower end of the pouring element (2) preferably ends in a plurality of fingers (2.2) equidistantly arranged along said lower end of the pouring element (2). These fingers (2.2) of the pouring element (2) prevent the pouring element (2) from uncoupling from the base body (1).

The upper end of the base body (1) may comprise a diametrical narrowing (1.2) of such a diameter that it hugs the outer wall of the pouring member (2), whose lower end forms an inner ring (1.3).

Thus, the hooks (2.2) of the pouring element (2) can fit into place, without uncoupling, inside said inner ring (1.3) arranged on the base body (1).

On the other hand, a spring (3) is arranged between the base body (1) and the pouring element (2). Said spring (3) rests on the lower end of the base body (1) and exerts such a force on the pouring element (2) that it pushes it outwardly of the base body (1).

As can be seen in the figures, the spring (3) is isolated inside an encapsulated housing (5). Said housing (5) is formed by an inner cylindrical wall (5.1), which juts out from the base body (1) and is telescopically pressure-inserted in an outer cylindrical wall (5.2) arranged in the centre of the pouring element (2).

Preferably, the inner cylindrical wall (5.1) of the encapsulated housing (5) comprises its open upper end (5.1.1) and its closed lower end (5.1.2).

In turn, said lower end (5.1.2) of the inner cylindrical wall (5.1) of the encapsulated housing (5) is preferably part of the lower end of the base body (1).

The outer cylindrical wall (5.2) of the encapsulated housing (5) may be fixed to the pouring member (2) by means of a plurality of stiffening ribs (7) equidistantly arranged along the outer perimeter (5.2.4) of said outer cylindrical wall (5.2).

Preferably, the outer cylindrical wall (5.2) of the encapsulated housing (5) comprises its open lower end (5.2.1) and its closed upper end (5.2.2).

Likewise, the upper end (5.2.2) of the outer cylindrical wall (5.2) of the encapsulated housing (5) may include an internal projection (5.2.3) in which the upper end of spring (3) fits.

A peripheral duct (6) is formed between the housing (5) and the inner walls (1.7, 2.3) of the base body (1) and the pouring element (2). Thus, the liquid is poured outwardly of the container without its coming into contact with the spring (3).

Likewise, the upper end of the pouring element (2) preferably ends in an anti-drip lip (2.1) preventing the liquid from flowing on the outside the container when it is poured.

On the other hand, the device comprises a cap (4) which, owing to it being coupled to the base body (1), retracts the spring (3) and the pouring member (2) into the cavity (1.1) of the base body (1).

Advantageously, in order to facilitate the coupling of the cap (4) to the base body (1), the latter comprises on its upper end an outer ring (1.5) arranged on a stop-shaped diametrical flaring (1.4). The cap (4) in turn comprises a lower-closure inner slot (4.1) in which said outer ring (1.5) of the base (1) body fits.

On the other hand, said stop-shaped diametrical flaring (1.4) arranged on the upper end of the base (1) body allows restricting the penetration of said base body (1) in the outlet (9.1) of the container (9).

Additionally, the cap (4) may comprise an upper-closure inner slot (4.2) in which the anti-drip lip (2.1) of the pouring element (2) fits, contributing to the sealing of the container.

Finally, to complete the sealing of the container, a capsule (8) could be placed on the outlet (9.1) of the container (9) once said container (9) is filled with the contained liquid. The capsule (8) can be of any material, e.g. aluminium, plastic, shrink wrap, etc., and houses the cap (4) inside.

Upon pressure being exerted by the mounting machine (not shown in the figures) on the capsule (8), the latter forces the pouring member (2) to retract into the cavity (1.1) of the base body (1), whilst at the same time the coupling of the cap (4) to the base (1) body is achieved.

The machine exerts said pressure for enough time to allow its cutting wheels to rotate around the container (9), cutting in the material of the capsule (8) the threads that are located on the outside of the outlet (9.1) of the container (9).

At that moment, if preferred, a weakening line or seal (8.1) is also made on the lower portion of the capsule (8) which allows, once the rotation of the capsule (8) takes place during use, said seal (8.1) to be broken and said capsule (8) to be unscrewed.

Once the capsule (8) is unscrewed, the cap (4) held therein disengages from the base body (1) and the pouring element (2) protrudes due to the thrust of the spring (3).

The invention claimed is:

1. A device for pouring liquid held in a container (9), comprising a base body (1), which snap fits onto an outlet (9.1) of the container (9), said base body (1) comprising inner walls (1.7, 2.3), said base body (1) forming a cavity (1.1) in which a pouring element (2) is held, a spring (3) arranged between the base body (1) and the pouring element (2) which pushes the pouring element (2) out of the base body (1), a cap (4) which, owing to said cap (4) being coupled to the base body (1), retracts the spring (3) and the pouring element (2) into the cavity (1.1) of the base (1) body, the cap (4) being arranged inside a capsule (8) which screws onto the outside wall of the outlet (9.1) of the container (9), characterised in that the spring (3) is isolated inside an encapsulated housing (5) formed by an inner cylindrical wall (5.1) and an outer cylindrical wall (5.2), the inner cylindrical wall (5.1) being located on the base body (1) and telescopically pressure-inserted in the outer cylindrical wall (5.2), the outer cylindrical wall (5.2) being arranged in the center of the pouring element (2), and a peripheral duct (6) is formed between the housing (5) and the inner walls (1.7, 2.3) of the base body (1) and the pouring element (2) for pouring the liquid outwardly of the container (9).

2. The device for pouring liquid held in a container according to claim 1, wherein the inner cylindrical wall (5.1) of the encapsulated housing (5) comprises an open upper end (5.1.1) and a closed lower end (5.1.2).

3. The device for pouring liquid held in a container according to claim 2, wherein the lower end (5.1.2) of the inner cylindrical wall (5.1) of the encapsulated housing (5) is part of the lower end of the base body (1).

4. The device for pouring liquid held in a container according to claim 1, wherein the outer cylindrical wall (5.2) of the encapsulated housing (5) is fixed to the pouring element (2) by means of a plurality of stiffening ribs (7) equidistantly arranged along an outer perimeter (5.2.4) of said outer cylindrical wall (5.2).

5. The device for pouring liquid held in a container according to claim 1, wherein the outer cylindrical wall (5.2) of the encapsulated housing (5) comprises an open lower end (5.2.1) and a closed upper end (5.2.2).

6. The device for pouring liquid held in a container according to claim 5, wherein the upper end (5.2.2) of the outer cylindrical wall (5.2) of the encapsulated housing (5) includes an inner projection (5.2.3) in which an upper end of the spring (3) fits.

7. The device for pouring liquid held in a container according to claim 1, wherein the base body (1) comprises on an upper end (1.8), a diametrical narrowing (1.2) which hugs an outer wall of the pouring element (2).

8. The device for pouring liquid held in a container according to claim 7, wherein a lower end of the diametrical narrowing (1.2) of the base body (1) forms an inner ring (1.3), and a lower end of the pouring element (2) ends in a plurality of fingers (2.2) equidistantly arranged along said lower end of the pouring element (2).

9. The device for pouring liquid held in a container according to claim 8, wherein the plurality of fingers (2.2) of the pouring element (2) fit into position inside the inner ring (1.3) of the base body (1), preventing the pouring element (2) from uncoupling from the base body (1).

10. The device for pouring liquid held in a container according to claim 1, wherein the base body (1) comprises an outer ring (1.5) on an upper end (1.8).

11. The device for pouring liquid held in a container according to claim 10, wherein the cap (4) comprises a lower-closure inner slot (4.1) in which said outer ring (1.5) of the base (1) body fits.

12. The device for pouring liquid held in a container according to claim 1, wherein an upper end of the pouring element (2) ends in an anti-drip lip (2.1).

13. The device for pouring liquid held in a container according to claim 12, wherein the cap (4) comprises an upper-closure inner slot (4.2) in which the anti-drip lip (2.1) of the pouring element (2) body fits.

14. The device for pouring liquid held in a container according to claim 1, wherein the base body (1) comprises on an upper end a stop-shaped diametrical flaring (1.4) which allows restricting penetration of said base body (1) in the outlet (9.1) of the container (9).

* * * * *